US005393155A

United States Patent [19]

Ng

[11] Patent Number: 5,393,155

[45] Date of Patent: Feb. 28, 1995

[54] RING BINDER HOUSING

[75] Inventor: Weng I. Ng, Hong Kong, Hong Kong

[73] Assignee: World Wide Stationery Mfg. Co., Ltd., Kwai Chung, Hong Kong

[21] Appl. No.: 56,300

[22] Filed: Apr. 30, 1993

[51] Int. Cl.[6] ..... B42F 13/20

[52] U.S. Cl. ..... 402/31

[58] Field of Search ..... 402/29, 31, 36–39

[56] References Cited

U.S. PATENT DOCUMENTS 2,571,945 10/1951 Rennie ..... 402/39
4,368,995 1/1983 Cohen ..... 402/39

FOREIGN PATENT DOCUMENTS 2004816 4/1979 United Kingdom ..... 402/37
2004816A 4/1979 United Kingdom .
2209500A 5/1989 United Kingdom .

*Primary Examiner*—P. W. Echols
*Attorney, Agent, or Firm*—Heller, Ehrman, White & McAuliffe

[57] ABSTRACT

A plate for forming a housing member for a ring binder which is provided with at least one rib positioned longitudinally on the plate along each side thereof, wherein said ribs are provided along the substantial length of each side of the housing member plate.

5 Claims, 2 Drawing Sheets

RING BINDER HOUSING

This invention relates to ring binders to hold paper and the like for loose-leaf binders, files, folders and the like.

During the manufacture of prior art ring binders, a problem has been ascertained, namely that the upturned sides of the housing member of the ring binder have a tendency to spring back during formation. As a result, the sides of the housing member are not formed at the correct angle, and carrier plates positioned in the housing member can drop out.

It is an object of this invention to overcome the above problem.

In accordance with the invention, a plate for forming a housing member for a ring binder is provided with at least one rib positioned longitudinally on the plate along each side thereof.

Such an arrangement prevents any spring back of the sides of the housing member plate during forming of the housing member.

Suitably one or a plurality of ribs are provided along the substantial length of each side of the housing member plate.

Such ribs cause the sides of the housing member to be exactly normal to the rest of the housing member, and accordingly carrier rails inserted into the housing member will not tend to drop out.

Preferably one or a plurality of indentations are provided adjacent each side of the housing member plate.

Such indentations in co-operation with sides normal to the rest of the housing member totally prevent carrier rails of a ring binder from dropping out of the housing member during assembly.

Advantageously the indentations project from the housing member plate in the opposite direction to the ribs.

The invention will now be described by way of example with reference to the accompanying drawings in which.

Figure 1:
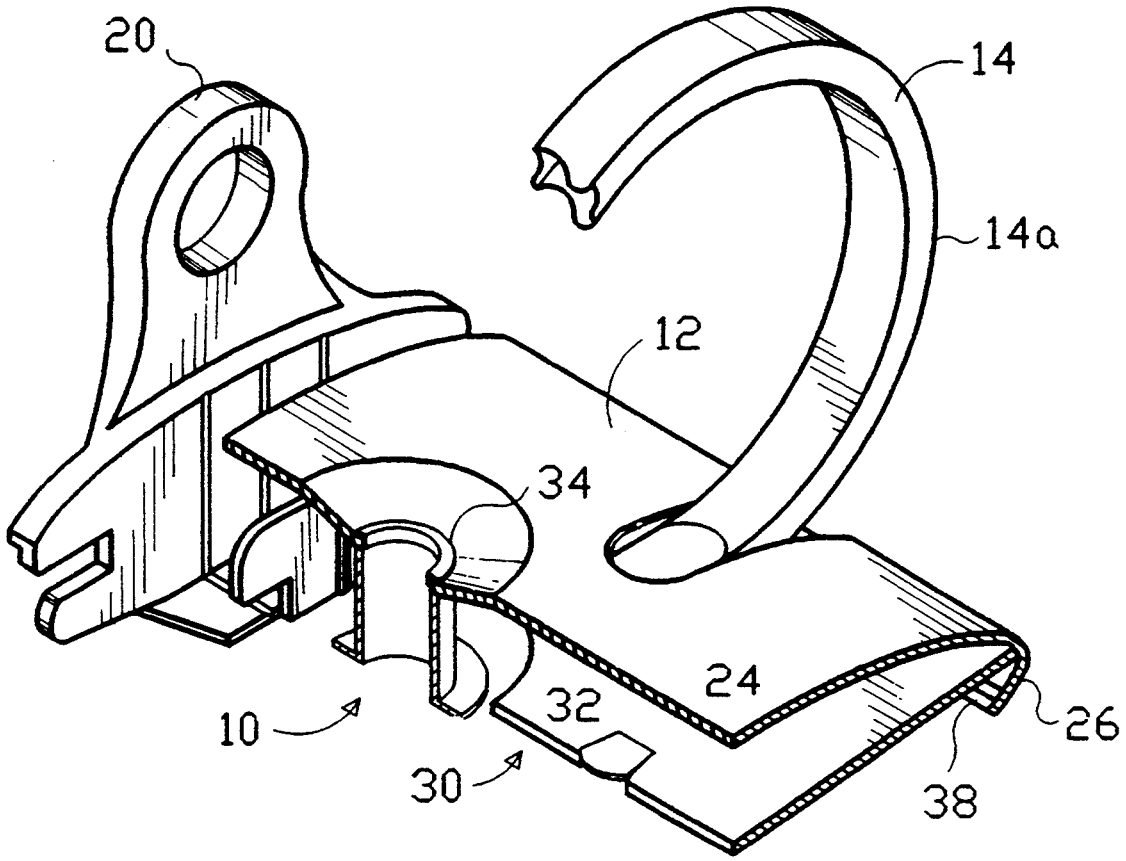
FIG. 1 shows a perspective view of a ring binder in accordance with the invention.

In FIG. 1 a ring binder 10 is shown for a loose-leaf binder comprising a base member 12, three ring members 14 spaced along the base member (only one of which ring members is shown in FIG. 1), and an opening and closing mechanism 20 at each end of the base member (again only one of which mechanism is shown in FIG. 1). The base member 12 comprises a housing member in the form of an upper rigid structure 24 which is curved in cross-section and which supports between its two overlapping sides 26 a pivotable lower structure 30 comprising two carrier rails 32 pivotable to each other along the longitudinal axis of the binder 10.

The ring members 14 are mounted on the pivotable lower structure 30 and in particular, one of the ring components (i.e. component 14*a*) of each ring member is mounted on the carrier rail 32 while the other ring component (not shown) of each ring member is mounted on the other carrier rail (also not shown).

Fastening means 34, meanwhile, are also provided on the upper structure 24 in order to secure the ring binder 10 to a paper folder or the like.

The two carrier rails 32 are movable (i.e. pivoted) relative to each other between a lower position and an upper position due to the action of the opening and closing mechanism 20 on each end of the carrier rails.

The opening and closing mechanism 20 is pivotably supported on each end of the upper rigid structure 24 and is in engagement with each end of the pivotable lower structure 30 in order to position the opening and closing mechanism 20 between the upper and lower structures.

The housing member 24 of the ring binder 10 is formed by pressing a pre-shaped metal plate using a pair of metal dies.

Figure 2:
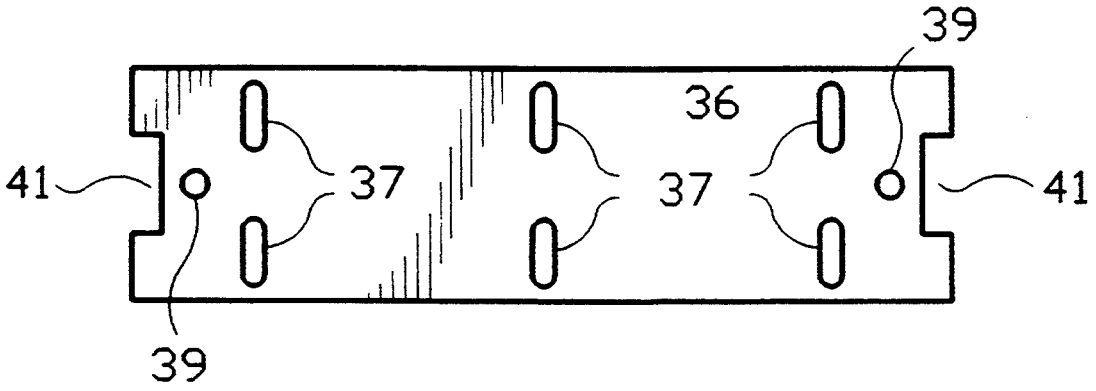
FIG. 2 shows a pre-formed metal plate to form the housing member of a prior art binder.

In FIG. 2 a prior art pre-formed metal plate 36 is shown which is flat and elongated, and provided firstly with six slots 37 through which the ring members 14 will pass when the ring binder is assembled, and secondly with an indentation 41 at each end in which the opening mechanism 20 will be positioned when the ring binder is closed. The plate 36 is also shown having two holes 39 through which the fastening means 34 will pass when the ring binder is positioned on a folder or the like, these holes 39 being only punched when the housing is being formed. Each side of the plate 36 is pressed into shape by a pair of metal dies whereby it is bent at each side substantially 90° to the rest of the plate. The metal itself, however, has a rebound elasticity, and therefore, the folded sides tend to deviate outwardly by a small angle from the abovementioned 90°.

In particular, when the metal plate 36 is forced to form a housing member, its inner and outer surfaces will be under a compression force and a tensile force respectively. Such will relieve and rebound outwardly when the dies are parted, and a small deviation angle between the sides and the normal is obtained. In this regard, different materials used and thicknesses have a different rebound elasticity.

This unexpected deviation angle affects the efficiency and speed of the assembly process.

Figure 3:
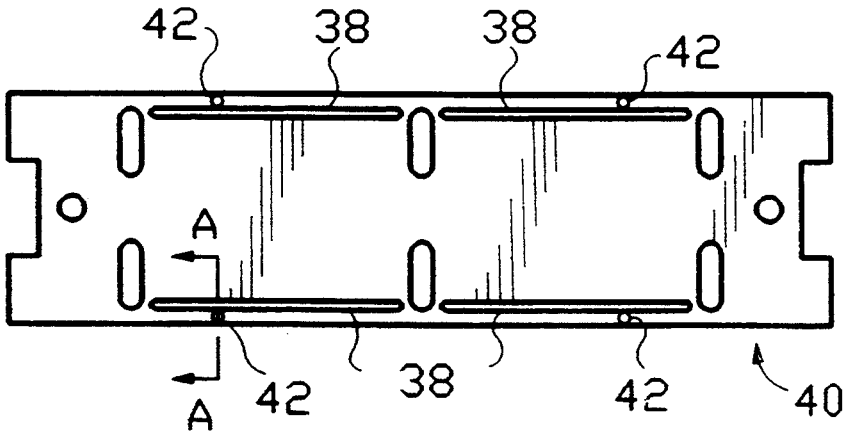
FIG. 3 shows a pre-formed metal plate to form the housing member of the ring binder shown in FIG. 1.
Figure 4:
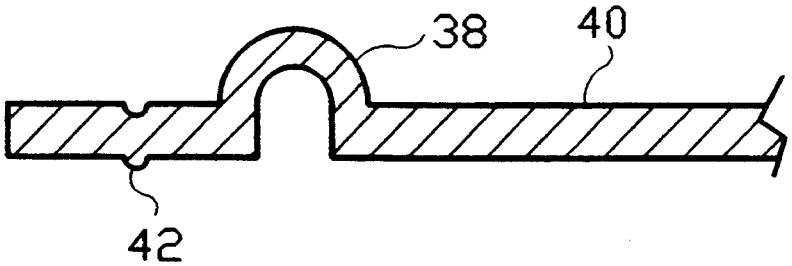
FIG. 4 shows a cross-sectional view of the plate of FIG. 3 as taken along lines A—A of FIG. 3.

In order to overcome this, it is best to create the required bent sides when the plate is still inside the dies, and this is achieved by providing a number of longitudinal ribs 38 along each side of a pre-formed plate 40 (see FIG. 3), and which extend outwardly from the plate.

When this modified metal plate 40 is pressed by the dies, upper forming knives touch the ribs 38, and push the plate into the housing form. In particular, both sides are thus bent further towards the normal due to the provision of the ribs 38, and create a small inner deviated angle to the normal. When the dies open, the effect of rebound elasticity of the plate 40 will reduce or remove the deviation angle of the prior art, and in particular, will form sides normal to the rest of the housing member, and sides parallel to each other, which is required.

The provision of a housing member having sides exactly normal to the rest of the housing member causes easier assembly, since the carrier rails 32 which are inserted in the housing member will not tend to drop out.

The plate 40 is also provided with four indentations 42 which project from the plate in the opposite direction of the ribs 38 (i.e. inwardly of the plate), and these indentations 42 form projections which in co-operation with sides normal to the rest of the housing member)

totally prevent the carrier rails 32 when inserted into the housing member from dropping out of the housing member during assembly.

The whole content of the two co-pending patent applications, Ser. Nos. 08/055,967 and 08/055,968 filed on the same day as this case by the same applicant are incorporated into this case by reference thereto.

I claim:

1. A housing member for a ring binder comprising:

a generally rectangular body;

two longitudinal sides normal to the body, each of the longitudinal sides having an outer edge; and at least one rib extending outwardly from the longitudinal sides positioned longitudinally adjacent each of the outer edges.

2. A housing member as claimed in claim 1 wherein one or a plurality of ribs are provided along the substantial length of the longitudinal sides of the housing member.

3. A housing member as claimed in claim 1 or 2 wherein one or a plurality of indentations are provided in the longitudinal sides of the housing member.

4. A housing member as claimed in claim 3 wherein the indentations project from the longitudinal sides of the housing member in the opposite direction to that of the ribs.

5. A ring binder formed using a housing member as claimed in claim 1.

* * * * *